United States Patent [19]

Stiles

[11] 4,344,253

[45] Aug. 17, 1982

[54] DOOR EDGE AND HINGE GUARD

[76] Inventor: Robert Stiles, 515 Fifth St., Niles, Ohio 44446

[21] Appl. No.: 241,767

[22] Filed: Mar. 9, 1981

Related U.S. Application Data

[63] Continuation of Ser. No. 54,656, Jul. 3, 1979, abandoned.

[51] Int. Cl.[3] ..... E06B 7/28

[52] U.S. Cl. ..... 49/383; 49/462

[58] Field of Search ..... 49/383, 462, 384, 460; 100/229

[56] References Cited

U.S. PATENT DOCUMENTS

| | | | |
|---|---|---|---|
| 1,444,994 | 2/1923 | White | 49/383 |
| 2,015,186 | 9/1935 | Kauzor | 49/383 |
| 2,681,479 | 6/1954 | Dixon, Sr. | 49/383 |
| 3,918,207 | 11/1975 | Aliotta | 49/462 |

*Primary Examiner*—Philip C. Kannan

*Attorney, Agent, or Firm*—Harpman & Harpman

[57] ABSTRACT

A door edge and hinge guard in the form of a U-shaped member is secured to a door frame longitudinally thereof to protect the edge of an open door and its hinge therein by resiliently deflecting objects such as shopping carts and the like away from contact with the edge of the door and the hinge.

4 Claims, 3 Drawing Figures

DOOR EDGE AND HINGE GUARD

This is a continuation of application Ser. No. 054,656, filed July 3, 1979, now abandoned.

BACKGROUND OF THE INVENTION

1. Field of the Invention

This invention relates to door edge and hinge guards of the type that protect the hinged edge of a door from damage.

2. Description of the Prior Art

Prior devices of this type have relied on covers for the exposed door edge and the space between the door and the frame. See for example U.S. Pat. Nos. 1,444,994 and 2,641,792.

In U.S. Pat. No. 1,444,994 a finger protection device comprises an offset body member attached at one longitudinal edge to an auto body adjacent a door opening therein.

Applicant's invention takes the form of an elongated cross sectionally U-shaped metal member with a right angular continuous cross sectionally L-shaped flange on one leg of said U-shape so as to form a mounting for the U-shaped member on a door frame.

In U.S. Pat. No. 2,641,792 a flexible elongated strip is attached at its opposite longitudinal edges to a door frame and a door to be protected. In a modification one edge of the strip is unattached and forms a cover by reason of its shape.

Applicant's invention remains in protective position when the door is partially or completely open and is always positioned in the door opening to deflect objects from the door edge and hinge.

SUMMARY OF THE INVENTION

A door edge and hinge guard comprises an elongated cross-sectionally U-shaped metal member for attachment to a door frame to provide a resilient protective deflector which will prevent damage to a hinge and the exposed edge of an open door attached to said frame.

DESCRIPTION OF THE PREFERRED EMBODIMENT

Figure 1:
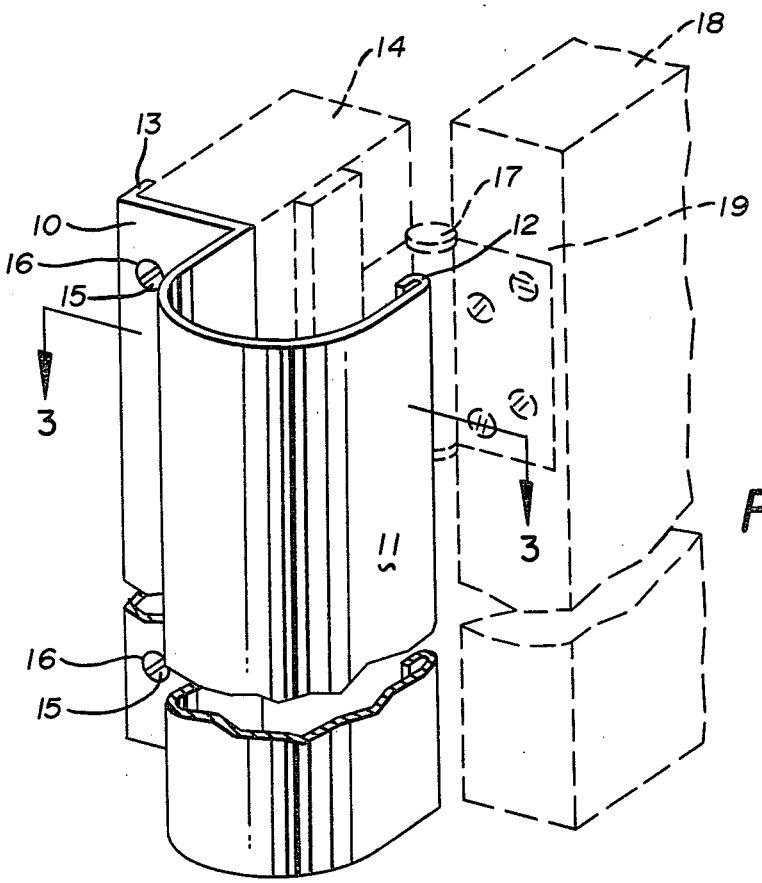
FIG. 1 is a front perspective view of the door edge and hinge guard with broken lines showing parts of a door, hinge and door frame.
Figure 2:
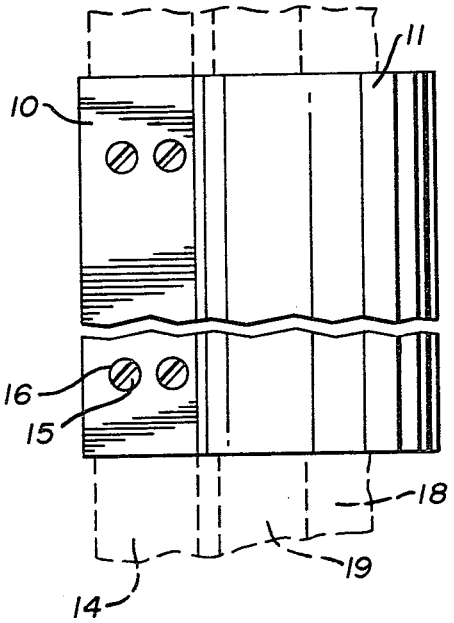
FIG. 2 is a front plan view of the door edge guard.

A door edge and hinge guard, as will be seen in FIGS. 1 and 2 of the drawings, comprises an elongated angle member 10 having a cross sectionally U-shaped member 11 extending continuously from one longitudinal edge of said angle member 10. The cross sectionally U-shaped member 11 has a longitudinally extending inturned edge bead 12 on its free edge. The angle member 10 includes a continuous edge flange 13 which extends from the opposite longitudinal edge of said angle member 10.

In the drawings, the angle member 10 is positioned on a door jamb and frame 14 shown in broken lines and is secured by a plurality of fasteners 15 through a like number of apertures 16 in said angle member 10.

Figure 3:
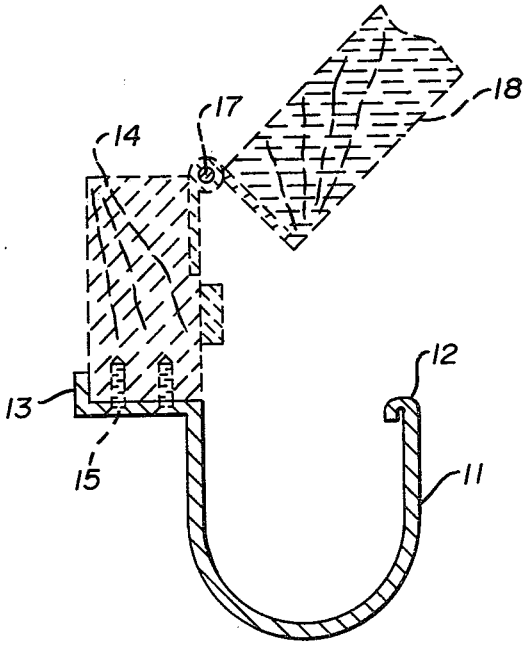
FIG. 3 is a top plan view of the door edge and hinge guard with broken lines illustrating portions of the door frame, jamb, and door.

Referring now to FIGS. 1 and 3 of the drawings, the door edge and hinge guard is shown positioned on the frame and jamb 14 adjacent a hinge 17 and door 18. The U-shaped body member 11 prevents the edge 19 of the door 18 and the hinge 17 from being damaged by deflecting objects away thereform. The smooth shape of the member 11 and its edge bead 12 protects a person from injury upon accidental engagement therewith. The edge flange 13 acts as a locator for alignment of the door edge and hinge guard on the frame and jamb 14 and adds rigidity to the device enabling it to protect the hinge 17 and door edge 19.

It will thus be seen that the attachment of the angle member 10 to the door frame and jamb 14 position the cross sectionally U-shaped body member 11 outwardly, both with respect to the frame and jamb 14 and the hinge 17 and door edge 19 so that in such position it effectively and resiliently deflects objects, such as shopping carts or the like, which would otherwise damage the hinge 17 or the door edge 19.

It will thus be seen that a new and useful device has been disclosed which can be made simply and inexpensively and easily and quickly and installed on a commercial door for example where it will prevent damage to the door, frame and jamb and hinges by yieldingly deflecting objects therefrom.

Although but one embodiment of the present invention has been illustrated and described, it will be apparent to those skilled in the art that modifications can be made within the scope of the disclosure and the appended claims and having thus described my invention what I claim is:

1. A door edge and hinge guard for attachment to a door frame and jamb to which one edge of a door is hinged, and comprising a cross sectionally U-shaped elongated body member having a half circular curved base section and spaced parallel arms extending therefrom, the ends of said arms lying on a common vertical plane, a right angular flange formed continuously on the end of one of said arms and outturned with respect to said U-shaped body member and means for attaching said right angular flange to said door frame and jamb so as to position said U-shaped body member in spaced relation to the hinged edge of said door with said half circular curved base section offset outwardly from said right angular flange and said door.

2. The door edge and hinge guard of claim 1 wherein said U-shaped body member is resilient metal.

3. The door edge and hinge guard of claim 1 and wherein a secondary right angular flange is formed on a longitudinal edge of said first mentioned right angular flange to extend in a direction opposite to said U-shaped body member.

4. The door edge and hinge guard of claim 1 wherein the space between the arms of the U-shaped body member is at least double the width of said right angular flange.

* * * * *